US010335000B2

(12) United States Patent
Lim

(10) Patent No.: US 10,335,000 B2
(45) Date of Patent: Jul. 2, 2019

(54) APPARATUS FOR THE DISPENSING OF WIPES AND HYGIENE PRODUCTS

(76) Inventor: Steven Lim, Ottawa (CA)

( * ) Notice: Subject to any disclaimer, the term of this patent is extended or adjusted under 35 U.S.C. 154(b) by 0 days.

(21) Appl. No.: 13/212,430

(22) Filed: Aug. 18, 2011

(65) Prior Publication Data

US 2013/0043267 A1 Feb. 21, 2013

(51) Int. Cl.

| | |
|---|---|
| ***A47K 10/42*** | (2006.01) |
| ***A47K 10/20*** | (2006.01) |
| *A47K 10/22* | (2006.01) |
| *A47K 10/32* | (2006.01) |

(52) U.S. Cl.

CPC ..... *A47K 10/426* (2013.01); *A47K 10/20* (2013.01); *A47K 10/421* (2013.01); *A47K 10/22* (2013.01); *A47K 2010/3233* (2013.01); *A47K 2010/3266* (2013.01)

(58) Field of Classification Search

USPC ..... 221/34, 96

See application file for complete search history.

(56) References Cited

U.S. PATENT DOCUMENTS

| | | | | |
|---|---|---|---|---|
| 4,913,312 | A * | 4/1990 | Boutin | 221/45 |
| 6,382,552 | B1 * | 5/2002 | Paul et al. | 242/595 |
| 6,497,345 | B1 * | 12/2002 | Wilker et al. | 222/192 |
| 6,588,626 | B2 * | 7/2003 | Sauer et al. | 221/49 |
| 6,857,540 | B2 * | 2/2005 | Mitchell | 221/45 |
| 7,147,129 | B1 * | 12/2006 | Menefield | 221/283 |
| 7,380,689 | B2 * | 6/2008 | Parietti | 221/282 |
| 7,497,351 | B2 * | 3/2009 | Amundson et al. | 221/96 |

* cited by examiner

*Primary Examiner* — Timothy R Waggoner

(74) *Attorney, Agent, or Firm* — Wilson Daniel Swayze, Jr.

(57) ABSTRACT

An apparatus for dispensing wipes and hygiene products with a rectangular container having a bottom, a top, and upstanding sides defining an enclosed space with one open side, and hanging disposed at the top or the sides of the dispenser and adapted for suspending the dispenser from an existing bathroom tissue holder's spindle roll or holder's bar used for mounting a conventional bathroom tissue roll, three hook like arms at the top end, a nipple on the outside of both side walls, a lip at the bottom of the front open side, openings on both side walls for to secure lugs, and detachable square side containers having lugs and an attached lid.

7 Claims, 6 Drawing Sheets

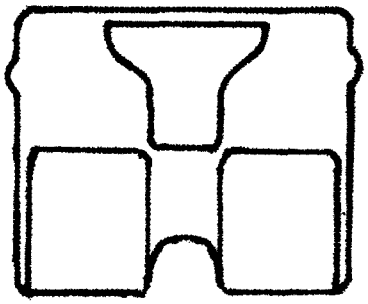
Figure 3
Figure 4
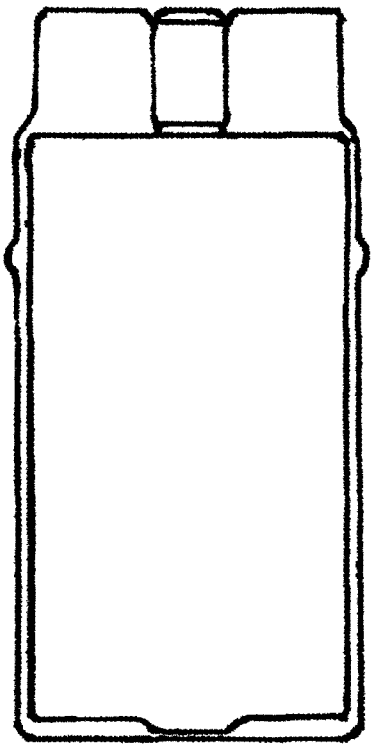
Figure 5
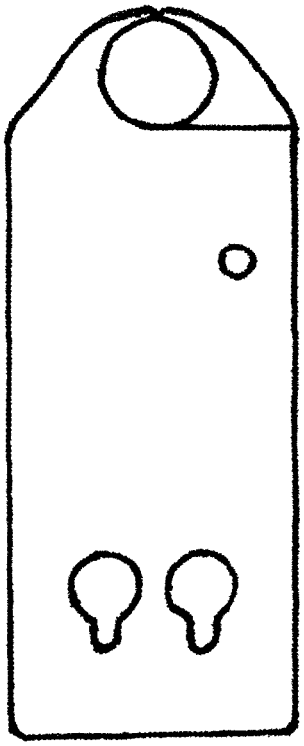

APPARATUS FOR THE DISPENSING OF WIPES AND HYGIENE PRODUCTS

FIELD OF THE INVENTION

The present invention relates generally to the field of dispensers, more specifically it relates to a bathroom tissue apparatus that dispenses both dry and moist wipes and/or feminine protection products; and can be hung from an existing bathroom tissue roll holder.

BACKGROUND OF THE INVENTION

Personal cleanliness involving conventional toilet paper dispensed from a toilet paper roll is a complex function requiring quantitative decision making and fine motor movements. The user must first determine the required amount of tissue needed, grasp both the roll and desired the tissue simultaneously in order to tear off the desired tissue,
fold and further manipulate the tissue into an adequate wipe that will not puncture during use Since the desired amount of tissue required is arbitrary, the process is considered wasteful if excessive or inadequate amounts of tissue is obtained. The groups of people which find greater difficulty with this task include children, the elderly, the disabled, and those with arm or hand injuries. To avoid the aforementioned problems, bathroom wipes have been designed in various sizes, shapes, materials, moisture content, and processes to offer greater convenience and improved cleaning with minimal effort required in preparing the wipe.

The personal hygienic care involving women requires other products relating to feminine protection. Since these products are normally hidden from sight retrieving them creates an inconvenience when needed. Thus, having these products close at hand and hidden from sight especially when combined with other bathroom tasks are both desirable and convenient.

The use of facial tissue is well known. Many types of containers and packaging have been developed to contain and dispense individual facial tissue. Such containers, or the more commonly known cartons, allow the user to remove an individual tissue one at a time in a manner which makes the adjacent tissue readily positioned for removal from the contained tissue group. This is a highly efficient means dispensing and using a single tissue as there is no paper manipulation nor guess work required by the user. Bathroom tissue shares similar composition to facial tissue but with greater water dispersive characteristics. Thus, a carton of bathroom tissue that is dispensed similar to facial tissue is relatively easier and more efficient to use compared to conventional bathroom tissue on tissue rolls. Similarly, a carton that contained a. stack of individually folded or prepared bathroom tissue would also be of greater ease and efficiency.

A few prior art structures lend themselves to a dispensing container for the containment and packaging of tissue sheets or wipes so that such a container may be adapted to a conventional bathroom roll holder. Boutin, U.S. Pat. No. 4,913,312, discloses a device that is mountable to an existing spindle and dispenses individual tissues from a contained stacked array. Boone, U.S. Pat. No. A106,616 discloses a device attachable to standard toilet tissue dispenser of a roll type to dispense supplemental material such as pre-wetted toilet sheets. Paul et al, U.S. Pat. No. 6,446,808, discloses a dispenser having supports attaching to a bathroom spindle housing a moist tissue roll. Newman et al., U.S. Pat. No. 6,626,395, discloses a dispenser for both pre-moistened wipes and dry bathroom tissue, and mountable to a conventional bathroom fixture using a mounting device.

Ross, U.S. Pat. No. 3,982,659, discloses a dispensing device employed in a bulk package having successive sheets that are individually dispensed. Julius et al., U.S. Pat. No. 4,428,497 discloses an open mouthed container for the housing of moist towelettes. Hotchkiss, U.S. Pat. No. 4,411,374 discloses a tissue dispenser system for the dispensing of interleaved facial tissue from a wall mounted dispensing cabinet.

None of the prior art structures lends itself to support or contain conventional size cardboard cartons of facial tissue while being adapted to conventional wall mounted bathroom tissue holders or a free standing bathroom tissue holders that use a bar to hold the bathroom tissue roll rather than a removable spindle roll. Accordingly, it would be desirable to provide a dispenser that houses and permits the: loading and unloading of conventional size tissue cartons, and is able to be adapted to the majority of bathroom tissue roll holders. It would also be desirable to have a dispenser that can be permanently or semi-permanently mounted, portable and/or free standing. While prior technology limits the containment of tissue to one kind of tissue such as individual sheets as described by Boutin; or rolled wet and dry tissue in both Paul, et al., and Newman, et al.; it would be desirable to provide a dispenser that allows for the dispensing of both moist and dry individual tissues or wipes. In addition, few if any prior art structures lends to the housing or dispensing of feminine hygienic products thus having an attached dispensing structure to accompany a bathroom tissue dispensing unit would also be desirable.

SUMMARY OF THE INVENTION

The primary object of the invention is to provide an apparatus that holds and dispenses various bathroom hygienic products such as bathroom tissue, wipes, moisten bathroom wipes, and feminine pads or tampons.

Another object of the invention is to provide an apparatus that can be mounted on an existing bathroom tissue holder, the holder's spindle, roll or the holder's bar, be fixed to a wall, or stand alone.

Another object of the invention is to provide an apparatus that can hold carton type packaging.

A further object of the invention is to provide an apparatus that can attach additional storage and dispensing containers.

Yet another object of the invention is to provide and apparatus that can hold more bathroom tissue than a standard bathroom tissue roll.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus for dispensing wipes and hygiene products comprising: a rectangular container having a bottom, a top, and upstanding sides defining an enclosed space with one open side, and hanging means disposed at the top or the sides of the dispenser and adapted for suspending the dispenser from an existing bathroom tissue holder's spindle roll or holder's bar used for mounting a conventional bathroom tissue roll, three hook like arms at the top end, a nipple on the outside of both side walls, openings on both side walls for means to secure lugs, and detachable square side containers having lugs and an attached lid.

BRIEF DESCRIPTION OF THE DRAWINGS

The drawings constitute a part of this specification and include exemplary embodiments to the invention, which may be embodied in various forms. It is to be understood that in some instances various aspects of the invention maybe shown exaggerated or enlarged to facilitate an understanding of the invention.

FIG. 3 is a top view of the invention of FIG. 1.

FIG. 4 is a front view of the invention of FIG. 1.

FIG. 5 is a side view of the invention of FIG. 1.

DETAILED DESCRIPTION OF THE PREFERRED EMBODIMENTS

Detailed descriptions of the preferred embodiment are provided herein. It is to be understood, however, that the present invention maybe embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
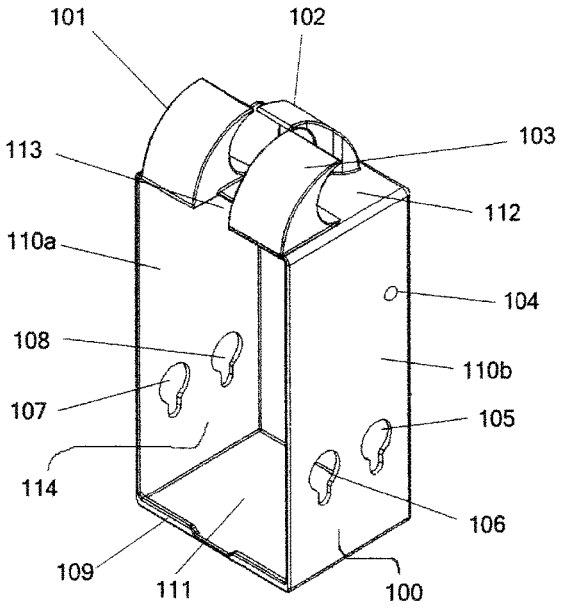
FIG. 1 is a perspective front view of the bathroom tissue dispenser according to an embodiment of the present invention.
Figure 2:
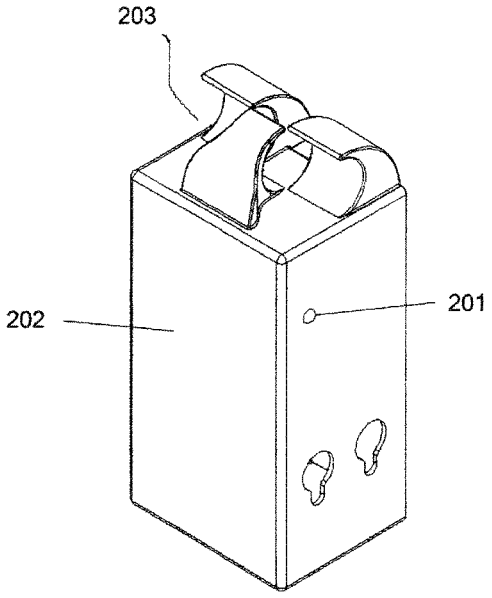
FIG. 2 is a perspective back view of the invention of FIG. 1.

FIGS. 1 to 2 illustrate a bathroom tissue dispenser according to a embodiment of the present invention. FIG. 1 is a perspective front view showing the appearance of the dispenser and the essential parts of it. Referring to FIGS. 1 and 2, the dispenser generally comprises a rectangular body 100, a top part 112, a front wall 109 with an opening 114 therein, a back panel 202, a bottom panel 111, and upstanding side panels 110*a* and 110*b* defining an enclosed space with one open side. The top part of 112 is formed with three curved hook shaped arms 101,102 and 103, which mutually overlap in such a way as to provide a loop like structure 203 through which the spindle or bar of an existing bathroom tissue roll holder can be inserted and the dispenser can be suspended therefrom. The outer sides of 110*a* and 110*b* is formed with semicircular nipples 104 and 201 that can be pressed fitted into the sockets of certain conventional bathroom tissue holders providing a suitable alternative means for hanging the apparatus. A carton of bathroom tissue or a stack of wipes can be loaded through the front opening 114. The bathroom tissue can be removed one by one through the front opening 114 as required. As seen in FIG. 1, the front wall 109 consists of a narrow lip like structure that allows for maximum opening clearance and acts like a stop to prevent a carton or stack of tissues from sliding out of the dispenser. The top wall 112 has a front cut-out 113 that provides a top opening from which the carton can be grasped and removed. In the illustrated embodiment the side walls 110*a* and 110*b* is formed with apertures 105,106,107 and 108 for the purpose of securing lugs 609 and 610 from separate attachable side dispensers FIG. 6 and FIG. 7.

Figure 6:
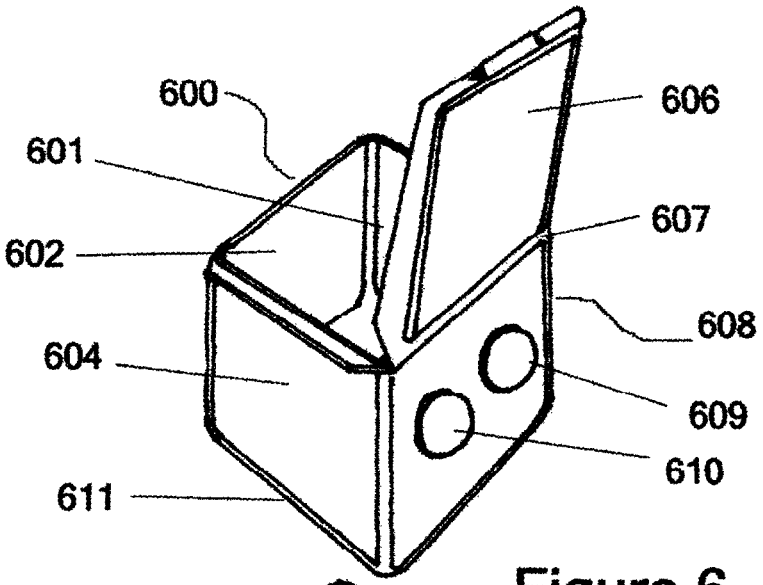
FIG. 6 is a perspective back view of the attachable side dispenser according to the present invention.
Figure 7:
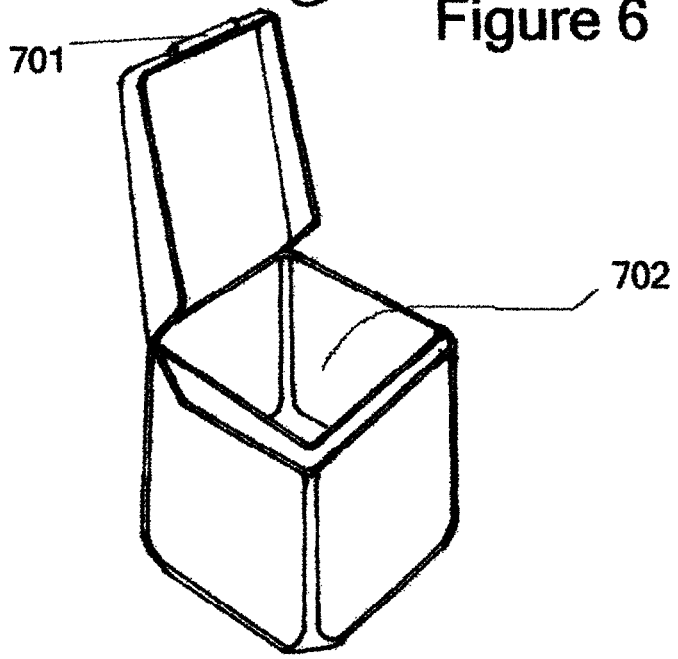
FIG. 7 is a perspective front view of the invention of FIG. 5.
Figure 9:
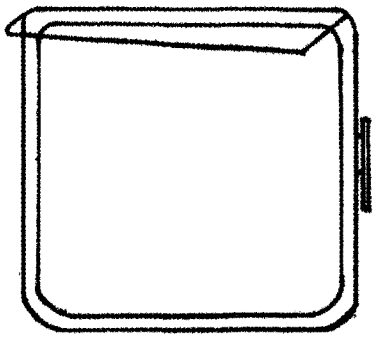
FIG. 9 is a side view of the invention of FIG. 5.
Figure 8:
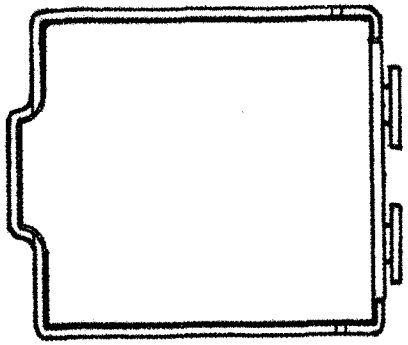
FIG. 8 is a top view of the invention of FIG. 5.
Figure 10:
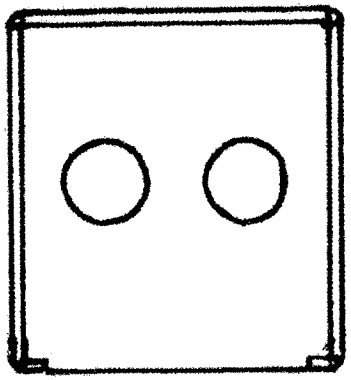
FIG. 10 is a back view of the invention of FIG. 5.
Figure 11:
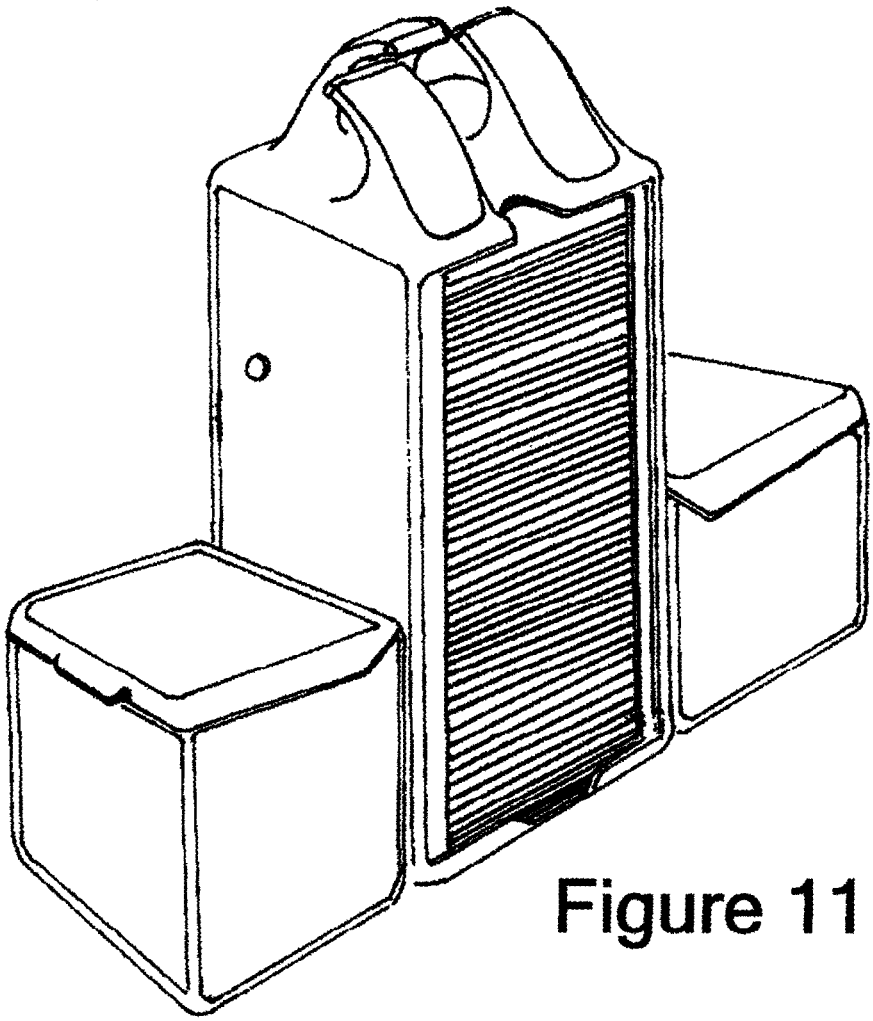
FIG. 11 is a perspective front view of the bathroom tissue dispenser according to an embodiment of the present invention together with the attached side dispenser mounted on both sides of the center main dispenser.
Figure 12:
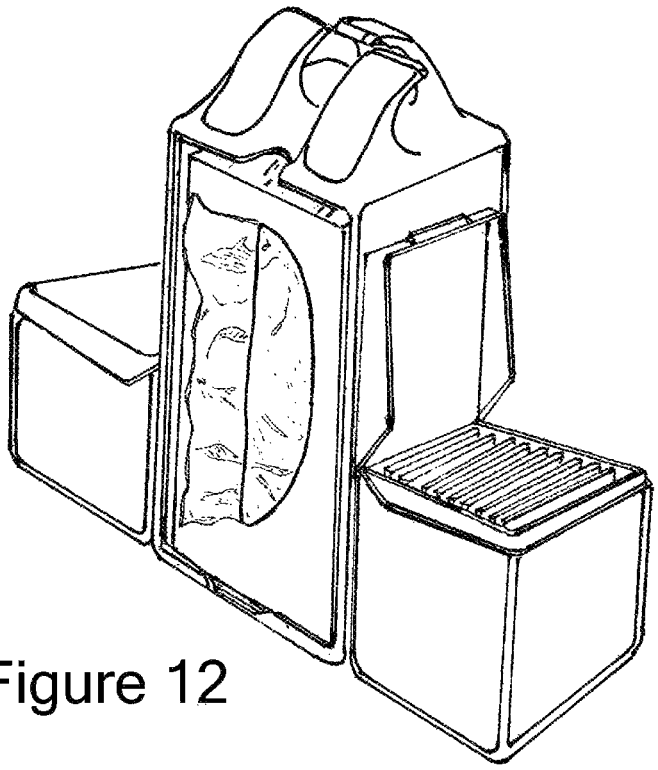
FIG. 12 is a perspective front view of the invention of FIG. 13 illustrating an open and closed position of the lid to the side dispenser and feminine hygienic products, and a carton of tissue wipes.

In accordance with the present invention, FIGS. 6 to 7 illustrate the detachable side adjoining dispensers or containers. FIG. 6 is a perspective rear view and FIG. 7 is a perspective front view showing the appearance of the adjoining dispenser and the essential parts of it. Referring to FIGS. 6 and 7, the adjoining dispenser comprises a square body 600, a front wall 602, side walls 601 and 604, a bottom panel 611, a. back panel 608, and a top panel or lid 606 which can be open and closed and is connected to the back panel 608 by a crease line (living) hinge 607, and creating a defined enclosed space 702. A carton of moist wipes or feminine hygiene products can be loaded into the compartment 702 of the side dispenser FIG. 7 by lifting the protrusion 701 on the lid 606. The lid 606 can be closed by using a press fit technique and the protrusion 701 on the lid 606. Provision is made for alternative locking techniques to keep the lid closed such as a. clip. The back panel 608 is formed with two circular protruding lugs 609 and 610 which are inserted through the openings 105 and 106 of the main dispenser FIG. 1, and the adjoining dispenser FIG. 6 can be suspended therefrom. Removal of the side dispenser FIG. 6 from the main dispenser FIG. 1 is achieved by positioning side dispenser FIG. 6 so that the lugs 609 and 610 are aligned to the proper opening of apertures 105 and 106 of the main dispenser FIG. 1.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A dispenser for dispensing wipes and hygiene products comprising:

a rectangular container having a bottom, a top, and upstanding sides defining an enclosed space with one open side; and hanging means disposed on the dispenser and adapted for suspending the dispenser from at least one of an existing bathroom tissue holder's spindle roll or holder's bar used for mounting a conventional bathroom tissue roll;

wherein the hanging means includes a nipple on the outside of at least one of the upstanding sides of the dispenser;

openings on the upstanding sides of the dispenser for means to secure lugs;

detachable square side containers having lugs and an attached lid; and three semicircular arms which mutually overlap and together form an aperture, suitable for suspending the dispenser from at least one of the conventional bathroom tissue holder's spindle roll or bar used for mounting a bathroom tissue roll.

2. A dispenser according to claim 1, in which the three semicircular arms forms a loop like structure.

3. A dispenser in accordance with claim 1, wherein the three semicircular arms can be slid over an existing bathroom tissue holder's spindle or bar in order to suspend or remove the dispenser from the spindle or bar.

4. A dispenser in according to claim 1, in which the hanging means includes two semicircular nipples.

5. A dispenser according to claim 1, wherein the hanging means can be press fitted into sockets of an existing bathroom tissue holder in order to suspend or remove the dispenser from the bathroom tissue holder.

6. A dispenser according to claim 1, wherein a front of the dispenser is provided with an opening, through which individual bathroom wipes can be removed.

7. A dispenser according to claim 6, and including a lip located on a bottom of the front of the dispenser.

* * * * *